US007262549B2

(12) United States Patent
Maeda et al.

(10) Patent No.: US 7,262,549 B2
(45) Date of Patent: Aug. 28, 2007

(54) VACUUM FLUORESCENT DISPLAY

(75) Inventors: Tadami Maeda, Mie (JP); Kouichi Okuyama, Mie (JP)

(73) Assignees: Noritake Itron Corporation, Mie (JP); Noritake Co., Ltd., Aichi (JP)

( * ) Notice: Subject to any disclaimer, the term of this patent is extended or adjusted under 35 U.S.C. 154(b) by 330 days.

(21) Appl. No.: 11/020,598

(22) Filed: Dec. 21, 2004

(65) Prior Publication Data

US 2005/0140267 A1 Jun. 30, 2005

(30) Foreign Application Priority Data

Dec. 26, 2003 (JP) ..... 2003-432308

(51) Int. Cl.
*H01J 1/62* (2006.01)

(52) U.S. Cl. ..... 313/495; 313/493

(58) Field of Classification Search ..... 313/495–497; 445/23–25

See application file for complete search history.

(56) References Cited

U.S. PATENT DOCUMENTS 5,463,276 A * 10/1995 Kawasaki et al. ..... 313/496

FOREIGN PATENT DOCUMENTS

| | | |
|---|---|---|
| JP | 05-275033 A | 10/1993 |
| JP | 08-017367 A | 1/1996 |
| JP | 10-125264 | 5/1998 |

* cited by examiner

*Primary Examiner*—Joseph Williams
(74) *Attorney, Agent, or Firm*—Blakely Sokoloff Taylor & Zafman

(57) ABSTRACT

A vacuum fluorescent display includes a display portion, filament cathode, grid, and a pair of filament support members. The display portion is arranged on a substrate and has an anode coated with a phosphor material in accordance with a pattern to be displayed. The filament cathode is applied above the anode of the display portion to be separate from the anode. The grid is arranged between the anode of the display portion and the filament cathode, and cooperates with the corresponding anode to display a predetermined pattern. The pair of filament support members are connected to an outside and extend the filament cathode. Part of the filament support members is clamped between a front glass plate and glass spacer and is extracted to outside.

5 Claims, 4 Drawing Sheets

VACUUM FLUORESCENT DISPLAY

BACKGROUND OF THE INVENTION

The present invention relates to a vacuum fluorescent display in which cathodes, grids, and anodes coated with phosphors are accommodated in a vacuum-evacuated envelope.

FIG. 6 shows a conventional flat type vacuum fluorescent display. Referring to FIG. 6, a vacuum fluorescent display 100 includes a substrate 111, an at least partly transparent front glass plate 112, and a glass spacer 113 arranged between the substrate 111 and front glass plate 112. The substrate 111, front glass plate 112, and glass spacer 113 are adhered to each other through frit glass portions 114 and 115 to form an envelope 101. In the envelope 101, wiring lines (not shown) are printed on the substrate 111, a plurality of anodes are arranged on the wiring lines through an insulating layer (not shown), and phosphors are attached to the anodes. The plurality of anodes form display portions 121 that can display a predetermined pattern. The plurality of anodes are disposed in, e.g., a matrix, and are indicated as display portions 121 formed of a large number of dots in FIG. 6. Strip-like or rectangular grids 122 are arranged above the display portions 121. For example, the grids 122 are formed of a plurality of segment grids 122*a* vertically provided substantially parallel to each other to cover the display portions 121, and support members 122*b* for the segment grids 122*a*. A plurality of cathodes 123 are arranged above the grids 122. For example, at least a plurality of filament cathodes 123 disposed in a direction perpendicular to the longitudinal direction of the grids 122 are accommodated.

The filament cathodes 123 are extended by a pair of filament supports 124 and 125, and led outside the envelope 101 through lead pins 126 and 127 as part of the filament supports 124 and 125, to supply power from the outside.

In this example, bases 124*a* and 125*a* of the filament supports 124 and 125 are disposed near the two ends in the longitudinal direction on the substrate 111 toward the substrate 111. The filament cathodes 123 are built by extending portions 124*b* and 125*b* vertically provided to the bases 124*a* and 125*a*. The lead pins 126 and 127 are led outside the envelope 101 through the gap between the substrate 111 and glass spacer 113.

The display portions 121 and grids 122 are connected to part of the wiring pattern printed in advance on the surface of the substrate 111. Pads 129 formed at one end in the short-side direction of the substrate 111 are connected to the other end of the wiring pattern. The pads 129 are connected to lead pins 128 led outside the envelope 101 through the gap between the substrate 111 and glass spacer 113. External power and signals necessary for operating the vacuum fluorescent display 100 are input to the display portions 121 and grids 122 through the lead pins 128 and pads 129.

In the vacuum fluorescent display 100, electrons extracted from the cathodes 123 pass through the grids 122, are accelerated by the anodes, and bombard on the phosphors applied to the anodes of the display portions 121. The bombardment on the phosphors causes light emission. This structure is described well in, e.g., Japanese Patent Laid-Open Nos. 05-275033 and 08-017367.

In the conventional vacuum fluorescent display 100 described above, as the bases 124*a* and 125*a* of the filament supports 124 and 125 are arranged on the substrate 111, regions to arrange the filament supports 124 and 125 must be reserved on the substrate 111, and be spared from that region on the substrate 111 where the display portions 121 are to be arranged. In other words, that region on the substrate 111 where the display portions 121 can be arranged is limited to a region obtained by excluding from the substrate 111 the regions to dispose the filament supports 124 and 125. It is difficult to further enlarge the display region of the vacuum fluorescent display 100.

SUMMARY OF THE INVENTION

It is, therefore, a principal object of the present invention to provide a vacuum fluorescent display in which the display area can be made larger than in the prior art.

In order to achieve the above object, according to the present invention, there is provided a vacuum fluorescent display including a substrate which forms part of an envelope, an at least partially transparent front glass plate which forms part of the envelope, and a spacer member which forms part of the envelope, is arranged at a peripheral portion of the substrate, and opposes the substrate and front glass plate to each other at a predetermined gap, comprising a display portion arranged on the substrate and having an anode coated with a phosphor material in accordance with a pattern to be displayed, a filament cathode built above the anode of the display portion to be separate from the anode, a grid which is arranged between the anode of the display portion and the filament cathode and cooperates with the corresponding anode to display a predetermined pattern, and a pair of filament support members which are connected to an outside and extend the filament cathode, wherein part of the filament support members is clamped between the front glass plate and spacer member and extracted outside.

DESCRIPTION OF THE PREFERRED EMBODIMENT

The present invention will be described in detail with reference to the accompanying drawings.

Figure 1:
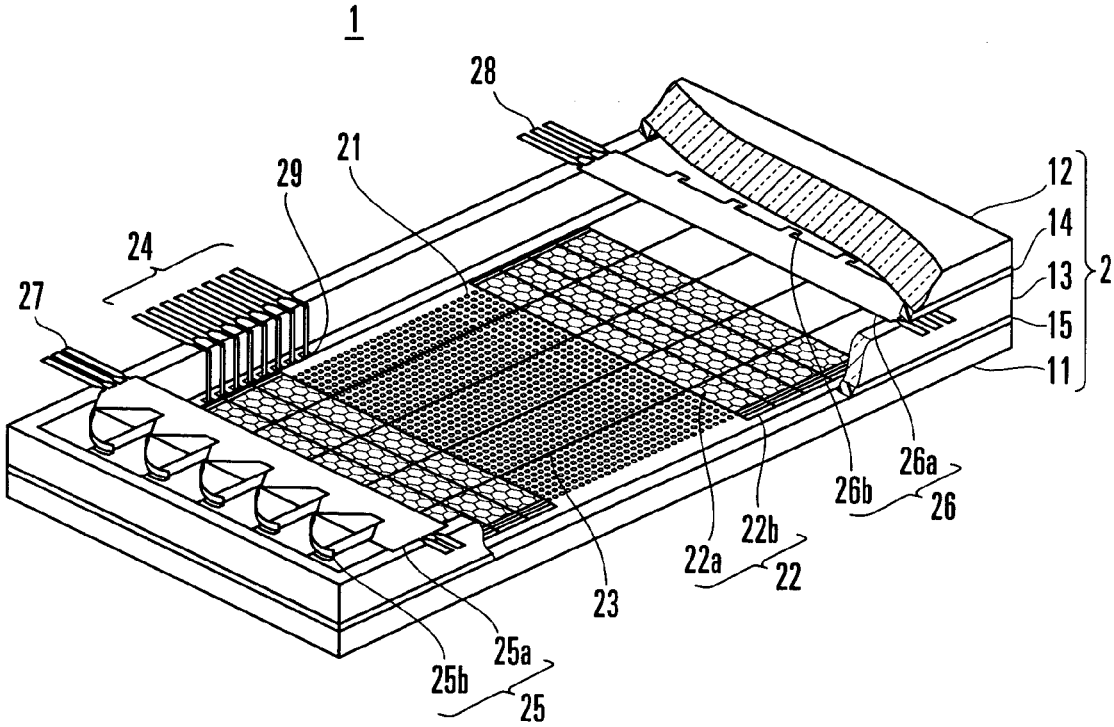
FIG. 1 is a partially cutaway perspective view showing the structure of a vacuum fluorescent display according to an embodiment of the present invention.
Figure 2:
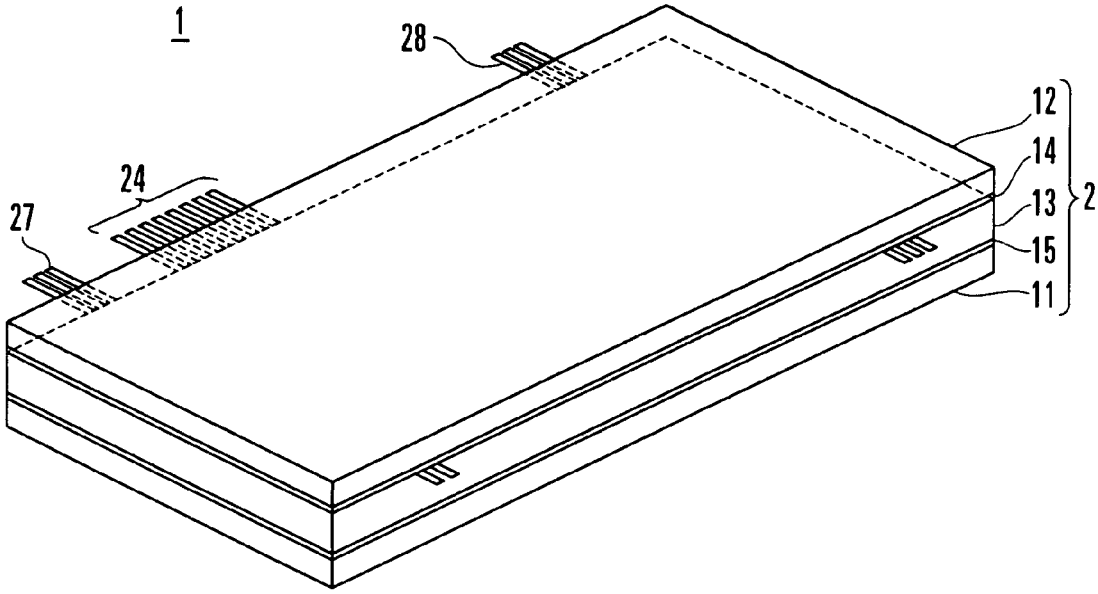
FIG. 2 is an overall perspective view of the embodiment of FIG. 1 seen from the front glass plate side.
Figure 3:
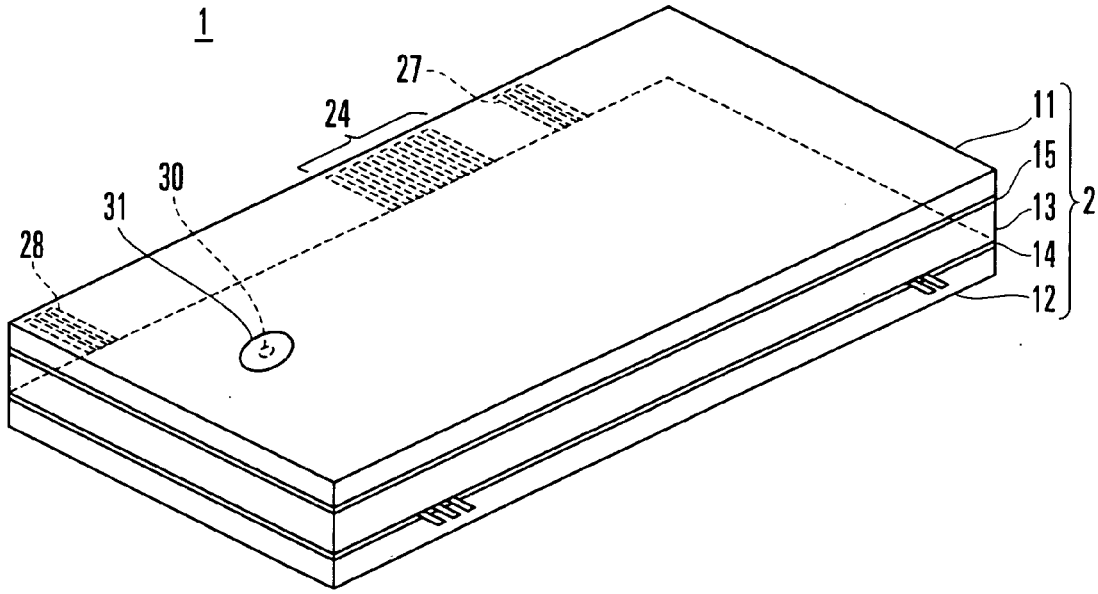
FIG. 3 is an overall perspective view of the embodiment of FIG. 1 seen from the substrate side.

FIGS. 1 to 3 show a vacuum fluorescent display according to an embodiment of the present invention. A vacuum fluorescent display 1 has an envelope 2 including a substrate 11 such as a glass plate, an at least partly transparent front glass plate 12, and a glass spacer 13 which is arranged at the peripheral portion of the substrate 11 and opposes the substrate 11 and front glass plate 12 to each other at a predetermined gap. The substrate 11 or front glass plate 12 and the glass spacer 13 are adhered and fixed to each other through known frit glass portions 14 and 15. In the envelope 2, electrical wiring lines are formed on the substrate 11. An insulating film is then arranged on the electrical wiring lines. The electrical wiring lines have a plurality of anodes (not shown) connected through, e.g., through holes. The anodes form a predetermined pattern. In this example, the anodes are dots, and cooperate with grids (to be described later) to form a matrix. Phosphors are placed on the anodes to form display portions 21, respectively. A plurality of grids 22 which form the matrix are arranged above the anodes to be separate from the anodes. In this example, the grids 22 have strip-like or rectangular shapes, and are vertically provided substantially parallel to each other above the display portions 21 to cover the display portions 21. Filament cathodes for emitting electrons are arranged above the grids 22. For example, at least a plurality of filament cathodes 23 disposed in a direction perpendicular to the longitudinal direction of the grids 22 are accommodated. When a filament cathode 23 is driven, a display portion 21 opposing a selected grid 22 is driven by a control signal introduced into the envelope 2 from the outside, and the phosphor of the selected display portion 21 emits light.

In this embodiment, the substrate 11 and front glass plate 12 are substantially rectangular when seen from the top, and are obtained by machining, e.g., soda glass into glass sheets each having a thickness of about 1 mm to 2 mm. The substrate 11 has an exhaust hole 30 to vacuum-evacuate the envelope 2, as is shown well in FIG. 3.

The glass spacer 13 has the shape of a substantially rectangular frame when seen from the top, and is made of, e.g., soda glass.

In this embodiment, the substrate 11 and front glass plate 12 oppose each other through the frame-like glass spacer 13 at their peripheral portions, and are adhered to the glass spacer 13 through the low-melting frit glass portions 14 and 15 to form the envelope 2. After the envelope 2 is vacuum-evacuated through the exhaust hole 30, the exhaust hole 30 is closed with a seal 31, to maintain the interior of the envelope 2 at a vacuum degree on the order of $10^{-5}$ Pa.

In this embodiment, the grids 22 have strip-like or rectangular shapes. Mesh-like openings 22*a* are located above the display portions 21. The plurality of openings 22*a* are thus formed. At the two end portions in the longitudinal direction of the grids 22, supports 22*b* are formed on the substrate 11 to dispose the grids 22 above the display portions 21 to be separate from the display portions 21 by a predetermined distance. The supports 22*b* are disposed in the vicinities of the two end portions in the longitudinal direction of the substrate 11.

The display portions 21 are connected to part of the wiring pattern formed on the surface of the substrate 11 in advance by printing or vapor deposition. The grids 22 are connected to part of another wiring pattern formed on the substrate 11 in the same manner. The wiring patterns are collected on part of the substrate 11 and connected to pads 29. The pads 29 are connected to lead pins 24 led outside the envelope 2 through the gap between the front glass plate 12 and glass spacer 13. External power and signals necessary for operating the vacuum fluorescent display 1 are input through the lead pins 24 and pads 29, and supplied to the display portions 21 and grids 22.

The filament cathodes 23 are extended by a pair of filament support members 24 and 25 in a direction (direction perpendicular to the longitudinal direction of the grids 22) along the longitudinal direction of the substrate 11. External power is supplied to the filament cathodes 23 through lead pins 28 and 27 led outside the envelope 2 from the filament support members 25 and 26.

The filament support members 25 and 26 have substantially rectangular bases 25*a* and 26*a*, and extending portions 25*b* and 26*b* vertically extending from the bases 25*a* and 26*a*, respectively, to support the filament cathodes 23.

The bases 25*a* and 26*a* are disposed along the front glass plate 12 such that their longitudinal directions are perpendicular to the longitudinal direction of the substrate 11 (along the longitudinal direction of the grids 22). The two end portions of each of the bases 25*a* and 26*a* are fixed as they are clamped between the edges near the two end portions in the longitudinal direction of the front glass plate 12 and the glass spacer 13. The lead pins 27 continuous from the two end portions of the base 25*a* and the lead pins 28 continuous from the two end portions of the base 26*a* are led outside the envelope 2.

In this manner, according to this embodiment, the bases 25*a* and 26*a* of the filament support members 25 and 26 are disposed not on the substrate 11 but along the front glass plate 12.

Thus, the display portions 21 and grids 22 can be arranged in a region where filament cathodes are disposed conventionally. Consequently, the display area of the vacuum fluorescent display 1 can be enlarged.

Unlike in the prior art, the bases 25*a* and 26*a* of the filament support members 25 and 26 are not formed on the substrate 11. This increases the degree of freedom of the position where the exhaust hole 30 is to be formed in the substrate 11.

In this embodiment, the bases 25*a* and 26*a* of the filament support members 25 and 26 are fixed between the front glass plate 12 and glass spacer 13. Unlike in the prior art, structures for disposing the bases 25*a* and 26*a* on the substrate 11 become unnecessary, and the structures of the filament support members 25 and 26 can be simplified. In particular, the widths in the short-side directions of the filament support members 25 and 26 can be decreased. This decreases the material cost to realize cost reduction.

According to this embodiment, as the bases 25*a* and 26*a* of the filament support members 25 and 26 are fixed between the front glass plate 12 and glass spacer 13, the gap between the substrate 11 and filament cathodes 23 can be decreased. Consequently, the thickness of the vacuum fluorescent display 1 can be decreased.

More specifically, it is conventionally difficult to decrease the gap between the filament cathodes 23 and display portions 21 to 1.5 mm or less. According to this embodiment, the gap can be easily decreased to 1.5 mm or less. When the gap between the filament cathodes 23 and display portions 21 decreases in this manner, the strength of the electrical field applied to the filament cathodes 23 increases, and electrons extracted from the filament cathodes 23 bombard on the phosphors of the display portions 21 effectively. Consequently, the luminance of the vacuum fluorescent display 1 improves.

Figure 4A:
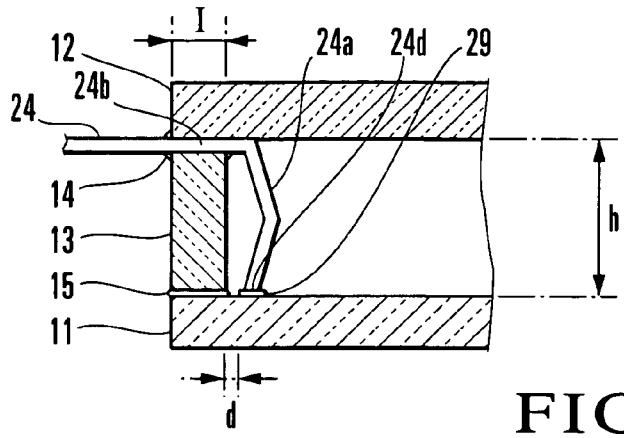
FIG. 4A is a sectional view showing the lead pin portion of the embodiment of the present invention.
Figure 4B:
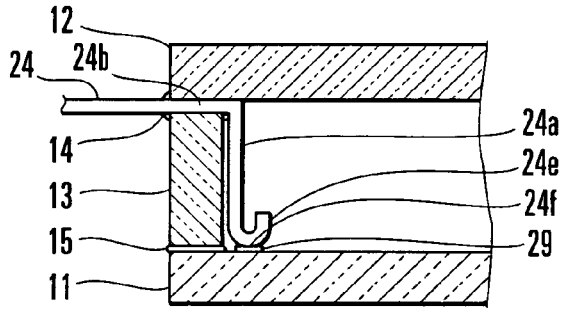
FIG. 4B is a sectional view showing a modification of the lead pin portion of the vacuum fluorescent display of the present invention.
Figure 4C:
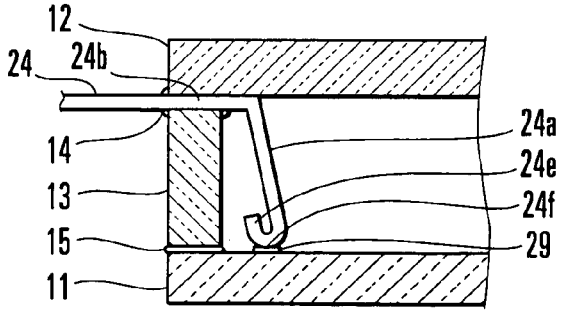
FIG. 4C is a sectional view showing another modification of the lead pin portion of the vacuum fluorescent display of the present invention.
Figure 5:
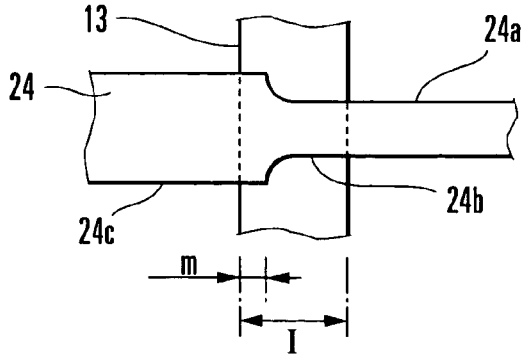
FIG. 5 is a schematic view showing the contact portion of a lead pin and spacer of the vacuum fluorescent display of the present invention.
Figure 6:
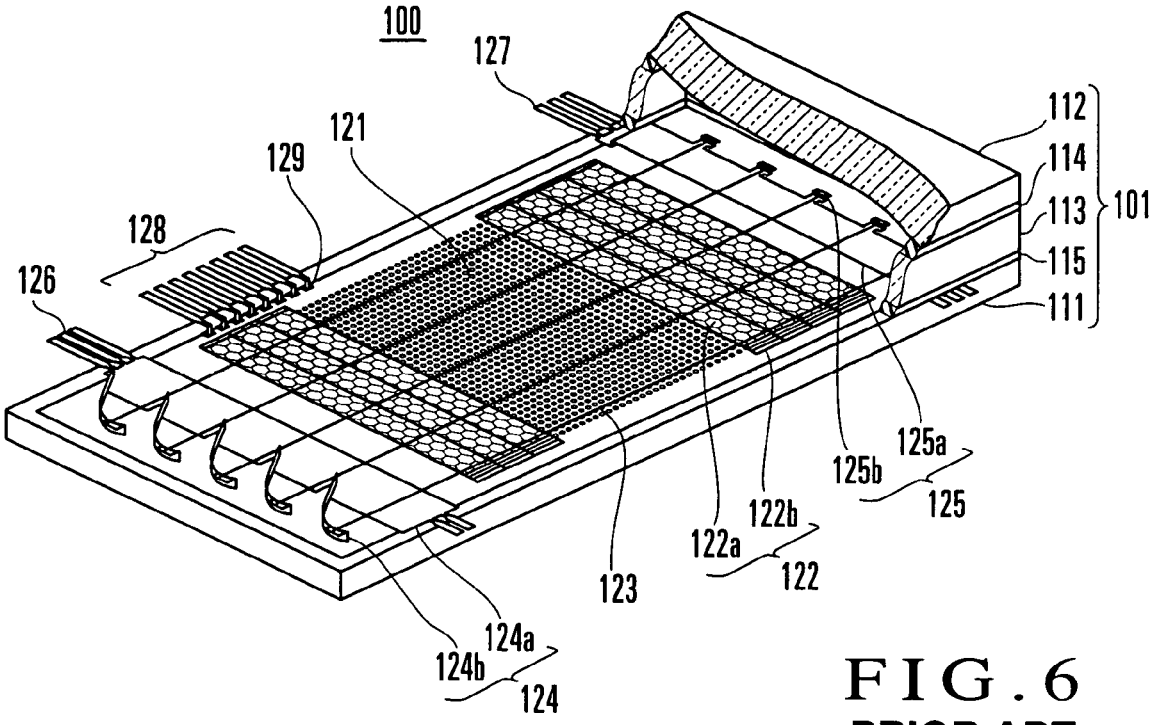
FIG. 6 PRIOR ART
FIG. 6 is a partially cutaway perspective view showing the structure of a conventional vacuum fluorescent display.

A method of manufacturing the vacuum fluorescent display 1 according to this embodiment will be described with reference to FIGS. 1 to 5. FIGS. 4A to 4C show the first to third modifications of the lead pin portion of the vacuum fluorescent display according to this embodiment, and FIG. 5 shows the contact portion of the lead pin and spacer of the vacuum fluorescent display according to this embodiment.

The wiring pattern to form the display portions 21, the anodes, and the phosphors are sequentially formed on the substrate 11 machined into a predetermined shape. The grids 22 with the supports 22*b* are disposed above the display portions 21 to be separate from the display portions 21 by a predetermined distance. Then, a driver chip (not shown) is disposed.

A frame integrally having the filament support members 25 and 26, lead pins 27 and 28, and lead pins 24 is prepared. The frame is bent into a predetermined shape, and the filaments 23 are extended between the filament support members 25 and 26.

When the frame is bent, the lead pins 24 are also bent as shown in FIG. 4. The arrangement and shape of the lead pins 24 will be described hereinafter.

Each lead pin 24 is made of, e.g., a 426 alloy, and has a thickness of 0.18 mm and a width of 0.2 mm to 0.25 mm. A length l of an engaging portion 24*b* of the lead pin 24 with respect to the glass spacer 13 depends on the thickness and shape of the glass spacer 13. In this embodiment, the length l of the engaging portion 24*b* can be set to 2.3 mm. As shown well in FIG. 5, the lead pin 24 is formed such that its outer portion 24*c* led outside the envelope 2 is wide and its inner portion 24*a* to be disposed in the envelope 2 is narrow. A contact length m with which the wide portion of the lead pin 24 and the glass spacer 13 are in contact with each other can be set to about 0.5 mm.

When the frame is bent, those portions of the lead pins 24 which are narrower than the engaging portions 24*b*, that is, the inner portions 24*a* to be disposed in the envelope 2 are bent.

As an example, when the vacuum fluorescent display 1 is seen from the direction (direction perpendicular to the extending direction of the filament cathodes 23) of one side surface of the frame-like glass spacer 13 as shown in FIG. 4A, the inner portions 24*a* of the lead pins 24 may be bent, near the front glass plate 12 toward the substrate 11, at near their engaging portions 24*b* to each form a spring structure, so as to come into elastic contact with the corresponding pads 29 of the substrate 11. Accordingly, the inner portions 24*a* each have a bent portion with a substantially V-shaped section that forms a spring structure at substantially its center, so that the inner portions 24*a* come into elastic contact with the corresponding pads 29 of the substrate 11. In this case, the length of each inner portion 24*a* is preferably larger by about 0.3 mm to 0.7 mm than an internal height (the gap between the substrate 11 and front glass plate 12 after the fluorescent display is fabricated) h of the vacuum fluorescent display 1 after the fluorescent display is fabricated. For example, when the internal height h is 2.6 mm, the internal portion 24*a* has a length of 2.9 mm to 3.3 mm.

With this shape, contact ends 24*d* of the lead pins 24 with the pads 29 are in tight contact with the pads 29 with a predetermined pressure. Thus, defective contact of the lead pins 24 and pads 29 can be prevented.

Figure 7:
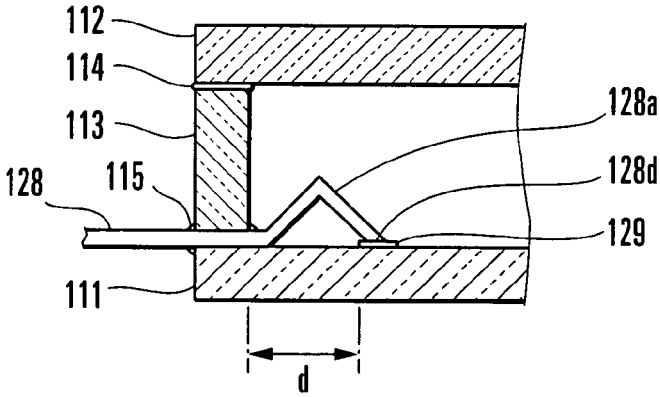
FIG. 7 PRIOR ART
FIG. 7 is a sectional view showing the lead pin portion of the conventional vacuum fluorescent display.

Conventionally, as shown in FIG. 7, the lead pins 128 are led outside the envelope 101 through the gap between the substrate 111 and spacer 113. In other words, the lead pins 128 are introduced into the envelope 101 through the gap between the substrate 111 and spacer 113. As the pads 129 are disposed on the substrate 111, to bring contact ends 128*d* of the lead pins 128, which are to be introduced into the envelope 101 from almost the same height as that of the pads 129, into tight contact with the pads 129 with a predetermined pressure, conventionally, inner portions 128*a* are formed to each have a substantially triangular section. With this structure, however, a distance d between each pad 129 and the spacer 113 must inevitably have a predetermined value (about 0.7 mm).

In contrast to this, according to this embodiment, as shown well in FIG. 4A, the inner portions 24*a* of the lead pins 24 are introduced through the gap between the front glass plate 12 and glass spacer 13, and the inner portions 24*a* are formed to each have a spring structure with a substantially V-shaped section. Therefore, the distance d can be theoretically set to 0 mm. Accordingly, the vacuum fluorescent display 1 can be downsized and its display area can be enlarged.

As shown in FIG. 4B, the inner portions 24*a* of the lead pins 24 may be bent, near the front glass plate 12 toward the substrate 11, at near their engaging portions 24*b*, so as to come into elastic contact with the corresponding pads 29 of the substrate 11, so that distal ends 24*e* of the inner portions 24*a* each have a substantially V-shaped section. Then, the distal ends 24*e* and distal ends 24*f* are formed on the lead pins 24, and a predetermined contact area can be ensured regardless of an angle at which the lead pins 24 are in contact with the pads 29.

As shown in FIG. 4C, the distal ends 24*e* may be bent in the opposite direction to that of FIG. 4B. More specifically, the distal ends 24*e* may be bent toward the glass spacer 13, to each have a spring structure with a substantially J-shaped section. In this case, the same operation and effect as those of FIG. 4A can be obtained.

In the case of FIGS. 4B and 4C, the distal ends 24*f*, through which the lead pins 24 and pads 29 come into contact with each other, of the distal ends 24*e* may be half-etched. More specifically, the distal ends 24*f* each have a spring structure which is half-etched for about 0.5 mm to 1.0 mm in the longitudinal direction of the lead pins 24. This can ensure the electrical connection of the lead pins 24 and pads 29.

In FIGS. 4A to 4C, the inner portions 24*a* of the lead pins 24 are bent, near the front glass plate 12 toward the substrate 11, at near their engaging portions 24*b*, to each form a spring structure. The bending position and bending angle can be set appropriately. More specifically, the bending position can be shifted to be closer to the engaging portions 24*b* side, contact end 24*d* side, or distal end 24*e* side than in FIGS. 4A to 4C. Similarly, the bending angle of the inner portions 24*a* near the engaging portions 24*b* can be freely set to be larger or smaller than in FIGS. 4A to 4C.

When the bending of the frame including the lead pins 24 is ended as described above, the glass spacer 13 having the frit glass portions 14 and 15 formed by calcination at their two edge portions and the front glass plate 12 formed into a predetermined shape are prepared. At this stage, the substrate 11, front glass plate 12, and glass spacer 13 are not temporarily fixed to each other but are separate from each other.

The glass spacer 13 is placed on the substrate 11, the frame is placed on the glass spacer 13, and the front glass plate 12 is placed on the frame. The substrate 11, glass spacer 13, frame, and front glass plate 12 are clamped with a clip or the like and calcined. Thus, the filament support members 25 and 26 are fixed between the edge portions of the front glass plate 12 and the glass spacer 13 through the frit glass portion 14.

The calcined envelope 2 is vacuum-evacuated through the exhaust hole 30 formed in the substrate 11 as an exhaust channel. The exhaust hole 30 is then sealed with the seal 31, and the interior of the envelope 2 is held at a vacuum degree on the order of $10^{-5}$ Pa.

Finally, the frame is trimmed to complete the vacuum fluorescent display 1 as shown in FIGS. 2 and 3.

As shown well in FIG. 2, according to this embodiment, the two end portions in the longitudinal direction of the base 25*a* of the filament support member 25 and the two end portions in the longitudinal direction of the base 26*a* of the filament support member 26, and/or the lead pins (27/28) are disposed between the front glass plate 12 and glass spacer 13. Thus, apparently, the lead pins 27 and 28 continuous from the bases 25*a* and 26*a* of the filament support members 25 and 26, respectively, are led outside the envelope 2 through the gap between the front glass plate 12 and glass spacer 13. The lead pins 24 are also led outside the envelope 2 from the interior of the envelope 2 via the gap between the front glass plate 12 and glass spacer 13.

As described above, according to this embodiment, the two end portions of the base 25*a* of the filament support member 25 and the two end portions of the base 26*a* of the filament support member 26 are disposed between the front glass plate 12 and glass spacer 13. Thus, in addition to an application in which the display portions 21 are to be formed in that region of the substrate 11 where the filament cathodes are conventionally disposed, the resultant structure can also be used in an application in which an exhaust hole is to be formed.

In this embodiment, a driver chip may be mounted in the envelope 2. In this case, as the filament support members 25 and 26 are not directly disposed on the substrate 11, when the driver chip is disposed on the substrate 11, the filament support members 25 and 26 will not be adversely affected by the shape, size, and position of the driver chip, the positions of wire bonding portions, and the like. Accordingly, even when a driver chip is mounted in the envelope 2, the shape and structure of the filament support members 25 and 26 can be designed appropriately and freely.

In the above vacuum fluorescent display, the filament support members may have lead pins that are to be led outside the envelope through the gap between the front glass plate and glass spacer.

The above vacuum fluorescent display may further have a second lead pin which is led outside the envelope through the gap between the front glass plate and glass spacer and which introduces a control signal for the vacuum fluorescent display into the envelope. The control signal refers to a driving current and driving voltage to drive the vacuum fluorescent display, a control current and control voltage to control display of the vacuum fluorescent display, or the like. More specifically, the control signal refers to a driving voltage and driving current to be input to the electrodes such as the anodes or grids. When a driver chip is incorporated, the control signal refers to an input signal and output signal to and from the driver.

In the above vacuum fluorescent display, that portion of the second lead pin which is inside the envelope may have a substantially V- or J-shape when seen from the side. The direction to "see from the side" refers to a direction to see the spacer member in front, particularly, to a direction perpendicular to the extending direction of the filament cathodes.

According to the present invention, the bases of the filament support members are disposed not on the substrate but along the front glass plate. Thus, the display portions and grids can be disposed on a region where cathodes are conventionally disposed. Consequently, the display area of the vacuum fluorescent display can be enlarged.

According to the present invention, the filament support members are not disposed on the substrate. This increases the degree of freedom of the position where the exhaust hole is to be formed in the substrate.

Even when a driver chip is mounted, the filament support members 25 and 26 will not be adversely affected by the shape, size, and position of the driver chip, the positions of wire bonding portions, and the like. Thus, the shape and structure of the filament support members can be designed appropriately and freely.

According to the present invention, the bases of the filament support members are fixed between the front glass plate and glass spacer. Unlike in the prior art, structures for disposing the bases of the filament support members on the substrate become unnecessary, and the structures of the filament support members can be simplified. In particular, the widths in the short-side directions of the filament support members can be decreased. This decreases the material cost to realize cost reduction.

As the gap between the substrate and filament cathodes can be decreased, the thickness of the vacuum fluorescent display can be decreased. This improves the luminance of the vacuum fluorescent display.

What is claimed is:

1. A vacuum fluorescent display including a substrate which forms part of an envelope, an at least partially transparent front glass plate which forms part of said envelope, and a spacer member which forms part of said envelope, wherein said spacer member is arranged at a peripheral portion of said substrate, and opposes said substrate and front glass plate to each other at a predetermined gap, said display further comprising;

a display portion arranged on said substrate and having an anode coated with a phosphor material in accordance with a pattern to be displayed;

a filament cathode built above said anode of said display portion to be separate from said anode;

a grid which is arranged between said anode of said display portion and said filament cathode and cooperates with said corresponding anode to display a predetermined pattern;

a pair of filament support members which are connected to an outside and extend said filament cathode, wherein part of said filament support members is clamped between said front glass plate and spacer member and extracted to the outside and wherein said filament support members further include (i) a first lead pin to be connected to the outside of said envelope, (ii) an extending portion which extends said filament cathode, and (iii) a base which supports said first lead pin and extending portion; and a second lead pin, said second lead pin led outside said envelope through a gap between said front glass plate and said spacer member to introduce a control signal into said envelope, wherein an inner portion of said second lead pin is positioned adjacent to a sidewall of said spacer member.

2. A display according to claim 1, wherein said second lead pin has a spring structure which comes into elastic contact with a pad of said substrate.

3. A display according to claim 1, wherein a distal end portion of said second lead pin has a structure that maintains a contact area regardless of an angle at which said distal end portion of said second lead pin is in contact with said pad.

4. A display according to claim 2, wherein said inner portion of said second lead pin is substantially V-shaped.

5. A display according to claim 2, wherein said inner portion of said second lead pin is substantially J-shaped.

* * * * *